US008232981B2

(12) United States Patent
Sandy

(10) Patent No.: US 8,232,981 B2
(45) Date of Patent: Jul. 31, 2012

(54) BEVERAGE CONTAINER STAND

(76) Inventor: Matt Sandy, Ardsely, NY (US)

( * ) Notice: Subject to any disclaimer, the term of this patent is extended or adjusted under 35 U.S.C. 154(b) by 237 days.

(21) Appl. No.: 12/004,427

(22) Filed: Dec. 21, 2007

(65) Prior Publication Data

US 2009/0159761 A1 Jun. 25, 2009

(51) Int. Cl.
*G09G 5/00* (2006.01)

(52) U.S. Cl. ..... 345/204; 345/2.1

(58) Field of Classification Search ..... 345/204, 345/1.1–2.3; 248/127, 146, 147; 361/600, 361/679.01, 679.02
See application file for complete search history.

(56) References Cited

U.S. PATENT DOCUMENTS

| | | | | |
|---|---|---|---|---|
| 5,339,548 | A * | 8/1994 | Russell | 40/324 |
| 6,084,526 | A * | 7/2000 | Blotky et al. | 340/691.6 |
| 2003/0076672 | A1* | 4/2003 | Head | 362/101 |
| 2003/0122730 | A1* | 7/2003 | Frank et al. | 345/1.1 |
| 2003/0210141 | A1* | 11/2003 | Iacovino | 340/539.1 |
| 2005/0161558 | A1* | 7/2005 | Stahl et al. | 248/146 |
| 2006/0191812 | A1* | 8/2006 | Oudekerk et al. | 206/459.1 |
| 2008/0010871 | A1* | 1/2008 | Holmes et al. | 40/1 |
| 2008/0083767 | A1* | 4/2008 | O'Neal | 220/739 |

* cited by examiner

*Primary Examiner* — Jimmy H Nguyen

(57) ABSTRACT

A beverage container stand has a housing with a portion configured for supporting a beverage container, a display for displaying images selected from the group consisting of moving images, stationary images, and both, and a unit for receiving the images and displaying the images on the display.

8 Claims, 1 Drawing Sheet

BEVERAGE CONTAINER STAND

BACKGROUND OF THE INVENTION

The present invention relates to beverage container stands.

Beverage container stands are known in the art and used in bars, beverage selling places, etc., and are sometimes called "glorifiers". The beverage container usually has a housing with a receptacle or similar structure to support a bottle. It is provided in many cases with light emitting means which illuminate the beverage container supported on the stand.

It is believed to be advisable to further improve the existing beverage container stands.

SUMMARY OF THE INVENTION

Accordingly, it is an object of the present invention to provide a beverage container stand which is a further improvement of the existing beverage container stands.

In keeping with these objects and with others which will become apparent hereinafter, one feature of the present invention resides, briefly stated, in a beverage container stand, comprising a housing with a portion configured for supporting a beverage container, a display for displaying images selected from the group consisting of moving images, stationary images, and both; and means for receiving the images and displaying the images on said display.

Another feature of the present invention resides, briefly stated, in a means for transmitting information about the stand for identification of the stand, allowing transmission of the images from outside into the stand.

A further feature of the present invention resides, briefly stated, in a means for transmitting the images from the stand to other beverage containers.

A further feature of the present invention resides, briefly stated, in a means for producing audio information accompanying the images displayed on the display.

A further feature of the present invention resides, briefly stated, in a means for storing the images for subsequent displaying the images on said display.

A further feature of the present invention resides, briefly stated, in a means for transmitting the images to be exhibited at a location selected from the group consisting of inside a supported beverage container, on the supported beverage container, and both.

A further feature of the present invention resides, briefly stated, in a controlling means for controlling the displaying of images on said display means.

A further feature of the present invention resides, briefly stated, in a means for providing a power supply and selected from the group consisting of a connection to an exterior power supply, a power supply accommodated on said housing and both.

A further feature of the present invention resides, briefly stated, in a means for connecting an outside source of the images to the stand for supplying the images into the stand and displaying the images on said display means.

A further feature of the present invention resides, briefly stated, in a means for illuminating the beverage container supported on the stand.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically showing a beverage container stand in accordance with the present invention.

DESCRIPTION OF THE PREFERRED EMBODIMENTS

Figure 1:
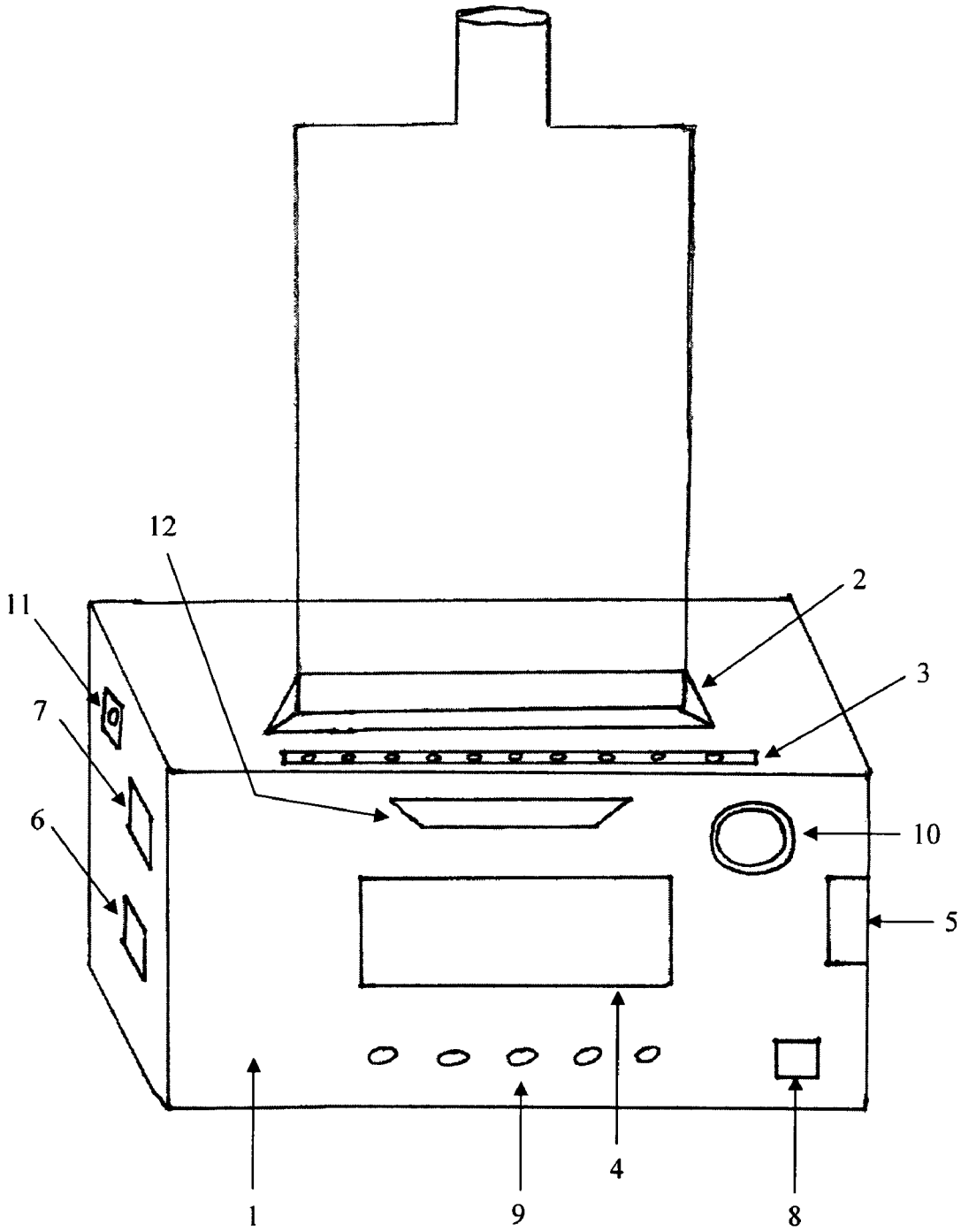

A beverage container stand in accordance with the present invention has a housing which is identified with reference numeral 1. The housing on its top wall has means for receiving a bottom of a beverage container, formed for example as a depression 2.

Light emitting means 3 are provided for illuminating the beverage container supported on the stand, and formed for example by a plurality of LEDs. The above described beverage container stand is known in the art.

In accordance with the present invention, the beverage container stand is provided with a display which is identified with reference numeral 4. The display 4 is provided for displaying moving images, stationary images, and both. The moving images can be movies, TV programming, advertising, etc. The stationary images can be texts, photographs, etc.

The images to be displayed on the display 4 can be stored in a memory identified with reference numeral 5 and provided in the stand.

The stand is provided with means 6 for receiving the images, to be subsequently displayed on the display 4. The receiving means 6 can be formed as a port in which an exterior device for transmitting the images can be plugged in or as a wireless receiver which can receive the images transmitted wirelessly. The receiving means 6 is connected with the display 4 in a known manner through an electrical or electronic circuit which allows the images to be transmitted from the port to the display 4 to be displayed on the display. Such circuits are well known in the art and used in many electronic devices.

The stand is further provided with transmitting means 7 which transmit a signal identifying the stand. The signal transmitted by the transmitting means can be received by a GPS system, supplied to a control center and then the images can be sent by the control center directly or through a hub, or through intermediate units, to the stand.

The stand is provided with further re-transmitting means which are identified with reference numeral 8. The re-transmitting means can transmit the images from the stand, either from the display 4 or directly from the receiving means 6, to beverage containers located outside of the stand and provided with corresponding receiving devices.

The beverage container stand is provided with control panel elements or buttons identified with reference numeral 9. The control buttons can be used to turn on and turn off the stand, for running the images displayed on the display means 4 forwardly and rearwardly, etc.

The stand is also provided with audio generating means 10, which can produce audio signals accompanying the images displayed on the display 4.

Power supply means are also provided and identified with reference numeral 11. The power supply means can be formed as a port 11 for connecting an exterior power supply, a cord and the like for connecting to the exterior power supply, or as a battery accommodated inside the housing 1.

Means are further provided for exhibiting the images inside or on the beverage container supported in the stand, as identified with reference numeral 12. The means 12 can be formed as an optical or electronic system which projects the images displayed on the display into the container or on the container, or projects the images received in the stand and displayed on passing the display, in the beverage container or on the container.

Optical systems for projecting images are known in the art and therefore not disclosed here in detail and any known optical system can be used for these purposes.

The beverage container stand in accordance with the present invention operates in the following manner.

When the beverage container stand is turned on by one of the controls 9, moving or stationary images are received through the receiving means 6 and displayed on the display 4. In order to send the images, the transmitting means 7 can be used for locating the stand. The audio means can operate for accompanying the images displayed on the display 4. The images can be transmitted by the retransmitting means 8 to other beverage containers. The light source 3 illuminates the container supported in the stand.

It will be understood that each of the elements described above, or two or more together, may also find a useful application in other types of constructions differing from the type described above.

While the invention has been illustrated and described as embodied in a beverage container stand, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

The invention claimed is:

1. A system, comprising a beverage container stand; a beverage container supported by said beverage container stand; and a plurality of further beverage containers located outside said stand and provided with receiving devices, wherein said beverage container stand includes a housing with a portion configured for supporting said beverage container, a display provided in said housing for displaying images selected from the group consisting of moving images, stationary images, and both, means for receiving said images and displaying said images on said display in said housing; means for transmitting the images from the display in said housing to be exhibited inside said supported beverage container or on said supported beverage container, and means for transmitting the images from said display in said housing to said further beverage containers located outside of said stand and provided with receiving devices.

2. A system as defined in claim 1, wherein said stand also has means for transmitting information about said stand for identification of said stand, allowing transmission the images from outside into said stand.

3. A system as defined in claim 1, wherein said stand also has means for producing audio information accompanying the images displayed on said display.

4. A system as defined in claim 1, wherein said stand also has means for storing the images for subsequent displaying the images on said display.

5. A system as defined in claim 1, wherein said stand also has controlling means for controlling displaying the images on said display.

6. A system as defined in claim 1, wherein said stand also has means for providing a power supply and selected from the group consisting of a connection to an exterior power supply, a power supply accommodated in said housing, and both.

7. A system as defined in claim 1, wherein said stand also has means for connecting an outside source of the images to said stand for supplying the images into said stand and displaying the images on said display.

8. A system as defined in claim 1, wherein said stand also has means for illuminating said beverage container supported on said stand.

* * * * *